United States Patent [19]

Fichtner

[11] 4,078,274

[45] Mar. 14, 1978

[54] SHOE LASTING APPARATUS

[75] Inventor: Rudi Fichtner, Rosbach, Germany

[73] Assignee: USM Corporation, Boston, Mass.

[21] Appl. No.: 744,877

[22] Filed: Nov. 24, 1976

[30] Foreign Application Priority Data

Dec. 8, 1975 Germany ..... 7539113[U]

[51] Int. Cl.[2] ..... A43D 21/00; A43D 89/00

[52] U.S. Cl. ..... 12/8.3; 12/34.5

[58] Field of Search ..... 12/8.3, 34.5, 145

[56] References Cited

U.S. PATENT DOCUMENTS

| | | | |
|---|---|---|---|
| 2,438,917 | 4/1948 | Kamborian | 12/8.3 |
| 3,591,878 | 7/1971 | Muhlbach et al. | 12/8.3 |
| 3,908,216 | 9/1975 | Gadd et al. | 12/8.3 |
| 3,971,089 | 7/1976 | Gadd et al. | 12/8.3 |

*Primary Examiner*—Patrick D. Lawson

*Attorney, Agent, or Firm*—Donald N. Halgren; Richard B. Megley; Vincent A. White

[57] ABSTRACT

An apparatus for lasting footwear, including a rotatable roll that is articulated on a spherical joint to permit the roll to adapt to and last any curvature it encounters on the insole of any shoe assembly it is operating upon.

3 Claims, 1 Drawing Figure

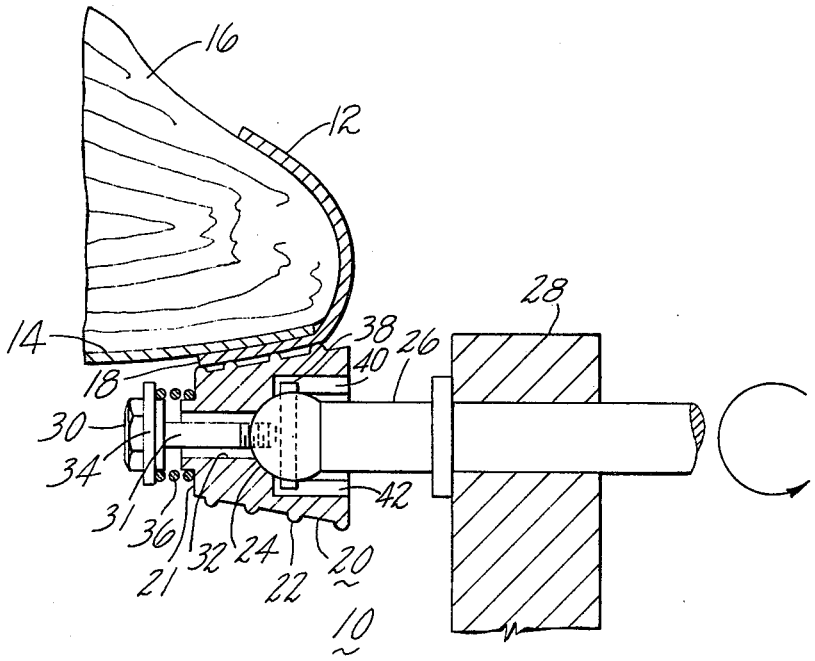
16
12
28
14
38
26
40
18
30
34
42
31
36
32
24
20
21
22
10

SHOE LASTING APPARATUS

BACKGROUND OF THE INVENTION

1. Field of the Invention

This invention relates to shoe lasting machinery, and more particularly, to shoe machines having rotatable rolls for wiping upper margins onto the shoe bottom.

2. Prior Art

In U.S. Pat. No. 3,908,216, filed on Apr. 10, 1974, and assigned to the assignee of the present invention, there is described a shoe lasting machine which is adapted to wipe an upper inwardly over a last bottom using a pair of driven rolls having helical lands. The rolls are carried on the machine so as to be permitted a bodily rocking movement in unison about an axis closely adjacent to and extending lengthwise of the shoe bottom.

Another U.S. Pat. No. 3,971,089, filed on July 27, 1976, and also assigned to the assignee of the present invention, describes a shoe lasting machine having helically landed lasting rolls for wiping the margin of a shoe upper. The rolls extend widthwise of the shoe bottom and are supportively disposed so the roll surfaces facing the shoe bottom generally correspond to the widthwise curvature of the shoe bottoms, each of the rolls being arcuately movable permitting a controllable change in the included angle therebetween.

In U.S. Pat. No. 3,000,024, there is described a shoe lasting machine having a cylindrically shaped roll for lasting a shoe bottom supported by a carriage that may rise and fall controllably in a generally vertical plane.

An object of the present invention is to provide a shoe lasting roll that wipes a lasting margin inwardly, the roll being permitted to swivel to provide a line contact therewith.

SUMMARY OF THE INVENTION

The present invention provides a lasting apparatus comprising a rotatable truncated roll having a land disposed helically therearound. The roll is biasedly mounted at one end of a swivel joint which is connected to a rotating shaft. The biased truncated roll provides a lasting roll that contacts the margin of the shoe with a line of wiping pressure. The swivel arrangement permits the lasting roll to follow any obliquity or widthwise curvature of the margin of any shoe bottom.

BRIEF DESCRIPTION OF THE DRAWING

The objects and advantages of the present invention will become more apparent when viewed in conjunction with the drawing which is a partial side elevational view of a lasting roll constructed according to the principles of the present invention.

DESCRIPTION OF THE PREFERRED EMBODIMENT

Referring now to the drawing, there is shown a side view of a shoe lasting apparatus 10, and a shoe assembly comprising a shoe upper 12, and an insole 14, on a last 16. The shoe upper 12, is shown as having been pulled over the bottom of the shoe assembly all around the periphery of the insole 14. The shoe upper 12, includes a lasting margin 18, which is wiped against the insole 14, after an application of adhesive or cement, has been applied therebetween.

The lasting margin 18, is wiped by lasting roll 20. The lasting roll 20, is a truncated cone 21, having a helical land 22, disposed therearound.

The lasting roll 20, forms the outer component of a spherical joint. A ball head 24, forms the inner component of the joint. The ball head 24, is disposed on the end of a rotatable shaft 226, journalled in a support block 28. The shoe assembly and the support block 28, are relatively movable with respect to another. The lasting roll 20, is yieldingly secured in a ball and socket relationship to the distal end of the ball head 24, by means of a bolt 30. The bolt 30, has a shaft 31, which extends through a bore 32, centrally disposed through the lasting roll 20. The shaft 31, of the bolt 30, is spaced from the walls of the bore 32. The bolt 30, has a flange 34, which retains a helical spring 36, providing a bias between the flange 34, and the outer end of the lasting roll 20, between which it is seated. A key 38, extends transversely across the ball head 24, and into a pair of grooves 40 and 42 formed in the lasting roll 20, generally parallel to the bore 32, extending therethrough. The ends of the key 38, disposed within the grooves 40 and 42, cause the lasting roll 20, to rotate with the rotatable shaft 26.

The spring 36, presses the lasting roll 20, against the spherical surface of the ball head 24. The lasting roll 20, is permitted a sufficient amount of universal movement on shaft 31, because of the correspondingly large bore 32, as compared with the diameter of the shaft 31, of the bolt 30. The lasting roll 20, has a mating concave surface that permits a universal sliding relationship between the lasting roll 20, and the ball head 24. This allows the lasting roll 20, to adjust its angular axial orientation with respect to the rotatable shaft 26. The lasting roll 20, is constantly being biased into a neutral position, that is, into coaxial alignment with the axis of the rotatable shaft 26, due to the effect of the spiral spring 36, thereon. This biasing permits a constant line of pressure to be applied to the margin 118, of any shoe bottom during lasting.

During operation of the shoe lasting apparatus 10, as the widthwise curvature of the margin of the shoe bottom being lasted changes, the axis-alignment of the lasting roll 20, automatically adapts itself to this curvature as a result of its biased spherical-joint mounting. The axis-alignment of the lasting roll 20, can shift not only in adapting to the obliquity of the margin, but also in respect to the direction towards the middle of the shoe, which is significant in many lasting applications.

Though the invention has been described with a certain degree of particularity, it is susceptible to modification without departing from the scope of the appended claims which are proffered in an examplary and not in a limiting sense.

Having thus described my invention what I claim as new and desire to secure by Letters Patent of the United States is:

1. A machine for lasting a margin of shoe upper mounted on last, said machine including:

a rotatable lasting roll for drawing said margin inwardly and pressing it against the bottom of a shoe;

said lasting roll being mounted on a spherical joint permitting angular axial movement in conformance with varying contours of the shoe bottom;

said joint including a ball head upon which said lasting roll is mounted, said lasting and said ball head having a movable relationship therebetween;

said ball head being fixedly attached to the distal end of a rotatable driving shaft received in a complementary socket in the roll wherein said ball head effects the rotation of said lasting roll through a keying member connected therebetween.

2. A machine as recited in claim 1, wherein a spring is disposed between a holding member which is comprised of a flanged bolt secured to said ball head, and said lasting roll, to create an axially directed bias therewith.

3. A machine as recited in claim 2, wherein said bolt extends through a bore in said lasting roll and has a spaced relationship therebetween, to permit angular axial displacement of said lasting roll with respect to said driving shaft.

* * * * *